United States Patent [19]

Ford, Jr.

[11] Patent Number: 5,033,338

[45] Date of Patent: Jul. 23, 1991

[54] SELF-LOCKING DEVICE

[76] Inventor: Vernon J. G. Ford, Jr., 28 Hemenway Rd., Cheektowaga, N.Y. 14225

[21] Appl. No.: 592,788

[22] Filed: Oct. 4, 1990

Related U.S. Application Data

[63] Continuation-in-part of Ser. No. 496,955, Mar. 21, 1990, Pat. No. 5,005,450.

[51] Int. Cl.[5] ..... B25B 7/14

[52] U.S. Cl. ..... 81/318; 81/324; 81/342; 81/381

[58] Field of Search ..... 81/308, 318, 324, 329, 81/339, 342, 381

[56] References Cited

U.S. PATENT DOCUMENTS

| | | | |
|---|---|---|---|
| 2,370,308 | 2/1945 | Hanson | 81/381 X |
| 2,787,925 | 4/1957 | Buchana et al. | 81/308 X |
| 3,126,775 | 3/1964 | Ramge | 81/318 |
| 3,257,878 | 6/1966 | Andersen | 81/318 |

*Primary Examiner*—James G. Smith

*Attorney, Agent, or Firm*—James J. Ralabate

[57] ABSTRACT

The locking tool of this invention comprises three or more pieces. All three pieces are connected with an axle pin. A first handle piece has one or more arc-like slots which criss-cross with one or more coextensive, vertically-disposed slots in the second handle. A third piece has one or more arc-like slots exactly as the first piece and is normally held in direct alignment with the first piece. A locking pin is movably positioned in and through the three slots. When the first and third pieces are held in alignment, the pin moves freely through the slot allowing the second piece to move freely against the first piece. When the third piece is rotated to misalign the slots from the first piece, the locking pin is pushed to a tilted position against the walls of the slots to lock both the jaws of the tool in position, and the pins themselves, in both a radial and rotational manner. Resistance to the pin movement either radial or rotational causes the pin to be tilted against the walls of the slots in such positions as to preclude natural reversed movement of the pin as in a one-way valve.

15 Claims, 2 Drawing Sheets

Fig. 1
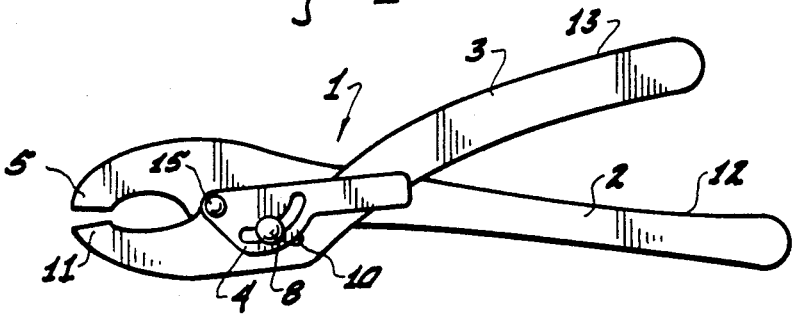
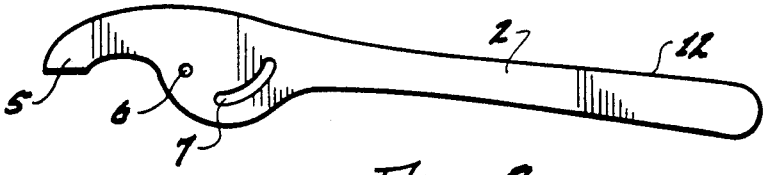
Fig. 2a
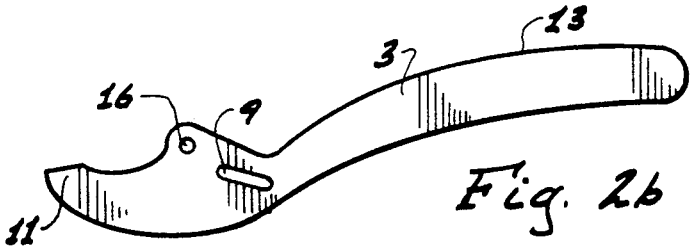
Fig. 2b
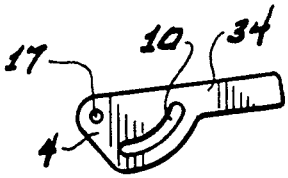
Fig. 2c
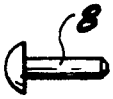
Fig. 2d
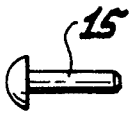
Fig. 2e Fig. 3
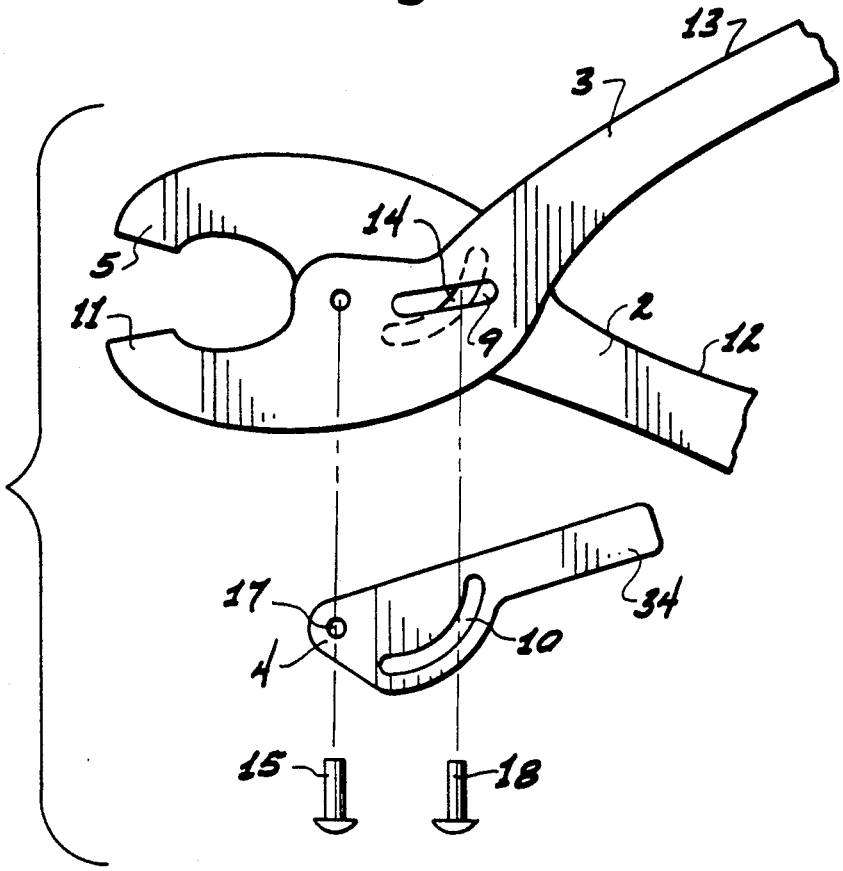
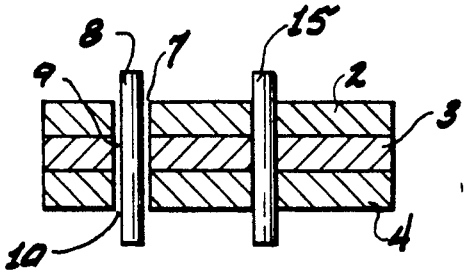
Fig. 4a
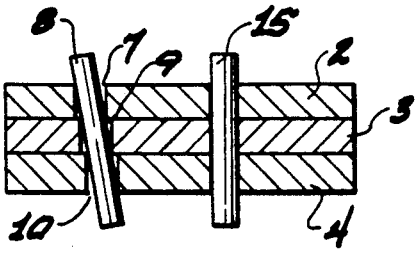
Fig. 4b

SELF-LOCKING DEVICE

This application is a continuation-in-part of parent application Ser. No. 07/496,955 filed in the U.S. Patent and Trademark Office on Mar. 21, 1990, now U.S. Pat. No. 5,005,450.

This invention relates to a locking device and, more particularly, to a self-locking tool that will lock an object held therein.

BACKGROUND OF THE INVENTION

There are known various devices for holding or locking an object in place such as vices and specifically-designed locking tools. The object to be locked in place can then be worked upon and can be held in a certain desired position. Some of these prior art devices use holding or locking jaws or portions that act upon a common connecting pin or other means. Some of these tools are disclosed in U.S. Pat. Nos. 682,701; 644,825; 1,026,270; 1,401,931; 1,450,875; 1,717,726; 2,574,909 and 4,633,558.

In U.S. Pat. No. 682,701 (Howland) a locking pliers is disclosed having a plurality of pieces movable along a multitude of pivot points. There is a central pivot A having 5 or 6 separate pieces movable thereabout. When the pliers of Howland is in the locked position an object is held between jaws B and C which are in turn pivotally-connected to D, H, J and r. Howland's device is relatively complex in usage and construction. Both handles of Howland's also must be held at all times during use in order to maintain an object locked in position. Also, Howland requires a high friction surface to function properly.

U.S. Pat. No. 644,825 (Jensen) discloses a wrench having handle means that can be locked in place by a spring means n. The spring is positioned on the bottom portion of one of the handles. When pin g of Jensen is pressed out of the socket h, it is slid into the socket g and spring n holds it in place. The holding device of Jensen is again relatively complex in construction and would be relatively expensive to manufacture.

U.S. Pat. No. 1,026,270 (Leonard) discloses a pipe wrench with a holding device to permit the wrench to be applied to a pipe or rod. A spring 15 in Leonard engages the handle 13 and its opposite end is secured to the shank of the wrench. The spring 15 locks the handle in position between the jaws 5 and 6. As in many locking tools, Leonard relies upon a spring means to provide the locking mechanism in his device.

In Whelan U.S. Pat. No. 1,401,931 an adjustable pipe wrench is disclosed which uses a quadrant attachment element together with two jaws to hold an object in position. The wrench of Whelan holds pipes or the like of various diameters with a three point grip, each of the three elements having a gripping surface.

McGill U.S. Pat. No. 1,717,726 and Burrows U.S. Pat. No. 2,574,909 each disclose wrenches having holding means to tightly hold items. Each discloses a wrench having several parts and several focal points for each part. Included in both patents are adjusting means to tighten or loosen objects held within the jaw assemblies of the respective wrenches.

In Teselsky U.S. Pat. No. 1,450,875 a pliers is disclosed having a third jaw section that will coact with the other two jaws of the pliers to prevent the article gripped from slipping. Handle means 5 and 6 of Teselsky each terminate with a jaw section, these jaw sections have a shank mounted around the exterior portion of one of the jaws. This shank acts as a third jaw which coacts in a gripping operation.

Spaulding, U.S. Pat. No. 4,633,558, discloses a tool for applying a spring clamp to an object. Spaulding utilizes a cam which is carried by one of the jaws and a pair of side plates pivotally supported by the other of said jaws having cam control tracks therein for effecting and controlling radial movement of said cam to complete closure of said clamp. There are means on a jaw for controlling rotation of the cam and the cam is engaged to a hook portion to the spring clamp to effect closure.

All of the above prior art devices are relatively complex in structure, most require springs for a locking effect and several are complicated to use. There is a need for a relatively simply-constructed tool that will lock an object in position without the need for springs or other such means.

SUMMARY OF THE INVENTION

It is therefore an object of this invention to provide a locking tool devoid of the above-noted disadvantages.

Another object of this invention is to provide a locking tool having two handle means wherein only one needs to be held after pressure has effected a locking of the object.

Another still further object of this invention is to provide a tool having a cam leverage to tilt the pin thereby locking the tool.

A still further object of this invention is to provide a locking tool that can be used to easily lock and release an object held therein.

Yet another object of this invention is to provide a locking tool that is relatively simple in construction and relatively inexpensive to use.

Still another object of this invention is to provide a locking tool that is relatively easy to use yet effective in holding an object securely.

Still yet a further object of this invention is to provide a tool that has means to lock in four directions; rotationally counter-clockwise, clockwise and radially in and out.

Yet still a further object of this invention is to provide a locking tool wherein once the lock is effected, handle pressure can be released without affecting the lock.

These and other objects are accomplished by the present invention by providing a novel locking tool comprising in combination two handle pieces and a third or remaining piece. All of these three pieces have an axle aperture through which they are connected to the other two pieces. A pin or other suitable means is extended through the three apertures and closed at both ends to movably fix the pin in position. All three pieces will rotate around the pin which acts as the focal point for the locking tool. The axle apertures and axle pin can be located on a plane above or below the slots described hereinafter. The first and second handle pieces have jaw portions at their upper end opposite the hand grip section of the piece. Below the jaw portion in the handle pieces is an axle aperture and below (or above) the axle aperture in the first handle piece is an arc-like slot. The second handle piece has a jaw portion at its upper end and contains an axle aperture below said jaw portion. Below said jaw portion in said second handle piece is positioned a vertically-disposed slot. This second handle piece with the vertically-disposed slot is sandwiched between the first handle piece and the third or remaining piece when the tool is assembled. The third or remaining piece has a short handle and contains an arc-like slot which spirals in the same direction as the arc-like slot in the first handle piece. The term "jaw" throughout this disclosure and claims will include any gripping surface. The arc-like slots can be of any dimension as long as they spiral in the same direction and are of approximately the same dimensions and configuration, i.e. arc radius, etc.

In a preferred embodiment the locking tool comprises at least three movably-connected pieces, a first handle piece, a second handle piece and at least one third piece. The first handle piece has an upper jaw portion, below said jaw portion an axle aperture and at least one arc-like slot positioned at a point below said axle aperture. The second handle piece has an upper jaw portion and below said jaw portion an axle aperture, and below said axle aperture at least one vertically-disposed slot. The third piece has an axle aperture and below said axle aperture at least one arc-like slot. Piece 4 is normally held in alignment with piece 2 by holding the handles 34 and 12 together as will be later shown in the drawings. The arc-like slots in said first handle piece and said third piece are about the same size and will spiral in the same directions when said first handle piece and said second handle piece and said third piece are assembled in said locking tool. The jaw portions in said first and second handle pieces are complementary jaw portions that cooperate to form thereby a gripping means. A locking pin is positioned through each of said arc-like and vertically-disposed slots.

The arc-like slots in the first handle piece and third piece spiral in the same directions which is critical to the present invention. When the first and second handle pieces are stacked and assembled with the third remaining piece, the spiralling slots are of approximately the same size, spiral in the same direction, have substantially the same arc-radius and are substantially identical in configuration. They must be aligned in at least a portion with the opening of the vertically-disposed slot in the second handle piece so that a locking pin can fit in an opening therethrough. The locking pin extends through the slots in the three pieces and through this opening. When the handle pieces spin around each other the slot walls push the pin by touching the pin with two adjacent sides of each of the arc-like slots. The rotation of the third piece, in the direction counter to the rotation that the second piece is being pressed against the first piece, will misalign the arc slots. This misalignment will move or force the locking pin to tilt since the pin is not supported at the other end of the stacked pieces. When the locking pin tilts, it locks the jaws together thereby holding an object securely between the jaws. At all times the locking pin is movably extended through the three slots in the first and second handle pieces and the third piece. To release an object locked between the jaw sections the user rotates the third piece relative to the first piece, back into position aligning the arc slots over each other thereby allowing the pin to straighten thereby releasing the lock and the object will fall loose. During use, the locking pin travels in an arc-like motion in the arc-like slots while it travels in an up-down motion in the vertically-disposed slot. When the handle parts are pressed together, the locking pin travels up the vertically-disposed slot toward the axle pin. The locking pin will lock in both a radial and in a rotational direction. All of the slots in the three pieces should have a width dimension slightly more than the diameter of the locking pin to permit it to be freely movable therein. In a preferred embodiment of the invention one slot is used in each of the three pieces, however, more than one slot in each can function equally well. It is important, however, that the arc-like slots whether one or several in the first handle piece and the third piece be positioned so that they spiral in the same direction. These arc-like slots can be concave or convex, if desired. The slot or slots in the second handle piece will be substantially vertically disposed and in alignment with each of the plurality of slots in the other two pieces. The locking pin, when the locking tool is in the unlocked mode, will be substantially horizontal, but when in a locked mode will be tilted off horizontal against at least one side of each arc-like slot. This causes the locking effect of this invention.

While there can be one slot or a plurality of slots in each of the three pieces, there must be at least one slot in each piece and at least one axle pin and at least one locking pin.

Regardless whether the handle pieces are rotated against the pin or the pin is pushed externally against the pieces, when blocking occurs the pin tilts. Since there is nothing to hold the pin parallel to the axle, the pin begins to tilt in the direction of the force on the pin whether the external force on the pin or the blocking force against the pin moving, from the rotation of the handle pieces.

Tilt occurs when the pin slides down the closest top or bottom slot wall; the pin attempts to fall down into this closest slot. It continues to fall until the opposite end of the pin hits the opposite two adjacent sides of the diamond hole. The opposite end of the pin then attempts to raise into its nearest slot (toward the original force in a reversed direction). Once it touches these slot edges the pivot begins. The points actually contacted along the slot walls are such that they closely balance or neutralize each other. The pin force directed at one wall equals the opposite reaction force at the opposite end of the pin in the opposite direction at the opposite wall.

While the locking pin remains parallel to the axle (even), the pin, if forced externally, would push toward one of the walls on at least two adjacent sides of the slots. This would begin to rotate the handle pieces in opposite directions to each other as the pin plows along the walls of the slot. These two walls rotate along with the affected two walls usually not even touching the pin.

When the pin becomes tilted, the pin can still plow toward a corner against its two adjacent walls but now the pin tilt has the opposite end of the pin touching the opposite adjacent walls. If the pin is externally pushed further, it begins to rotate the handle pieces. The opposite corner and its two walls now have no room or clearance to slide rotationally around the pin. The walls are blocked by the diameter of the pin being in a tilted shape and contacting said pin around and behind the circumference of the pin. The pin is held in position by the blocking force in one direction and by the opposing walls (one on each of the two plates) in the other direction. Additional force would only tend to tilt the pin more making the opposite two adjacent walls more blocked to a release rotation.

The tool of this invention rather than using one slot in each handle piece (as shown in the figures) can use a plurality of slots such as a multitude of arc-like slots as shown in FIGS. 5A–5F of parent application SN 07/496,955. These arc-like slots would be disposed around an axle aperture and would allow several locking pins to travel in these arc-like slots. This or any other suitable arrangement may be used using the general concept to augment the rotational and radial aspects of this invention.

The tool of this invention can be used in hand tools such as pliers or wrenches or in vices, other gripping devices, hinging devices with position locking and as a differential clutching or locking device to the relative speeds of rotation of the plates.

BRIEF DESCRIPTION OF THE DRAWING

FIG. 1 is a plan side view of the assembled locking tool of this invention.

FIG. 2 including FIGS. 2A–2E illustrate a side plan view of the disassembled main component parts or pieces of the locking tool in a preferred embodiment of this invention.

FIG. 3 is a top plan breakaway view of the interaction of the slots in the handle pieces of this invention showing a similar spiral in the arc-like slots.

FIG. 4 is a side schematic view showing in 4A the position of the locking pin in a normal condition and in 4B the position of the locking pin in a locked condition.

DETAILED DESCRIPTION OF THE DRAWINGS AND PREFERRED EMBODIMENTS

In FIG. 1 the locking tool 1 of this invention is illustrated in its assembled condition. The tool 1 comprises in this embodiment three main component pieces, a first handle piece 2, a second handle piece 3 and a third piece 4. The first handle piece 2 has in its upper portion a jaw section 5 and below the jaw section 5 an axle aperture 6 (see FIG. 2A). By "below" is meant when piece 2 is held vertically, at the top portion would be jaw 5 and "below" would be located aperture 6. Below the axle aperture 6 in first handle piece 2 is a first arc-like slot 7 through which a locking pin 8 will extend and travel. Locking pin 8 will also travel in and extend through a vertically-disposed slot 9 in second handle piece 3 (FIG. 2B) and an arc-like slot 10 in third piece 4 (FIG. 2C). Locking pin 8 (FIG. 2D) will move as handles when handle pieces 2 and 3 are moved together or pushed apart. When an object is placed between jaw sections 5 and 11 and handles 12 and 13 are squeezed together, locking pin 8 travels or moves in an arc-like fashion through slots 7 and 10 and moves up or down in vertical slot 9. As jaws 5 and 11 are closed upon and grip an object and closing pressure is exerted upon handles 12 and 13 the plate 4 is then rotated against handle 2 against the direction of handle 13. This causes locking pin 8 to be tilted off its original horizontal position and pushes up against or wedges against the walls of the slots 7 and/or 10 overlap with slot 9 to thereby lock the jaws 5 and 11 in position. When similar spiralling slots 7 and 10 overlap and move relative to each other (see FIG. 3) they form an opening. Locking pin 8 at some point along its length wedges against the walls of this opening 14 when the pin 8 locks in position. An axle pin 15 provides the focal point around which all of the pieces 2, 3 and 4 rotate in use. Axle pin 15 is disposed substantially horizontally through all three pieces 2, 3 and 4 via the apertures 6, 16 and 17 respectively. When locking pin 8 is in its normal condition (unlocked) it will be substantially parallel to the horizontally-disposed axle pin 15. When locking pin 8 is forced against the walls of slots 7 and 10 in a locked position, it will tilt away from its parallel position to axle pin 8. Regardless whether pieces 2 and 3 are rotated via axle pin 15 against the locking pin 8 or the pin 8 is pushed externally against the pieces 2 and 3, when locking occurs the locking pin 8 will tilt. Since there is nothing to hold the pin 8 parallel to the axle pin 15, the pin 8 begins to tilt in the direction of the force on the pin 8 whether the external force on the pin 8 or the blocking force against the pin 8 moving, from the rotation of pieces 2 and 3. Tilt of pin 8 occurs when the pin 8 slides down the closest top or bottom slot 7 or 10 walls. It continues to fall until the opposite end of the pin 8 hits the opposite two adjacent sides of the opening 14 (see FIG. 3). The opposite end of the pin 8 tends to raise into its nearest slot (toward the original force in a reverse direction). Once pin 8 touches these slot 7 and 10 edges, the pivot or tilt of pin 8 begins. The pin 8 force directed at one corner of opening 14 equals the opposite reaction force at the opposite end of the pin in the opposite direction at the opposite portion of opening 14.

In FIG. 2 the three component pieces 2, 3 and 4 of locking tool 1 are illustrated, piece 2 in FIG. 2A, piece 3 in FIG. 2B and piece 4 in FIG. 2C. The first handle piece 2 has a jaw section 5 at its upper terminal end and a handle section 12 at its opposite terminal end. Below the jaw section 5 is an axle aperture 6 through which axle pin 15 extends when the tool 1 is assembled. Below axle aperture 6 is positioned an arc-like slot 7 through which locking pin 8 will extend when tool 1 is assembled. Slot 7 has a width just slightly (enough for pin 8 to be freely movable therein) greater than the diameter of pin 8. It is critical to the present invention that arc-like slot 7 be disposed on first handle piece 2 in a manner that when assembled and stacked with the other two pieces 3 and 4, it will spiral or arc in the same direction and manner as slot 10 in third piece 4. When moved against or in relation to slot 7 and/or 10, slot 9 will form an opening 14 as shown in FIG. 3. Jaw section 5 will form the grip when it moves toward complementary jaw section 11 in second handle piece 3. In second handle piece 3 the upper section of piece 3 has an axle aperture 16 which will house axle pin 15 when pin 15 extends through the axle apertures 6, 16 and 17 in pieces 2, 3 and 4 respectively. Below aperture 16 in piece 3 is a substantially vertically-disposed (when assembled as in FIG. 1) slot 9 that will house together with slots 7 and 10 locking pin 8. When the term "substantially vertically disposed" or "vertically disposed" is used throughout this disclosure it is meant that the axis of slot 9 is from 0–25° off from a vertical drop line drawn vertically from the center of aperture 16. The slot 9 in FIG. 2 is drawn at an angle of about 14° off from a pure vertical line from the center of aperture 16. Pins 8 and 15 are shown having bevelled edges at their terminal ends, however any type bolt, screw, rod or the like can be used as long as it is freely movable in slots 7, 9 and 10 (in locking pin) or can suitably act as an axle pin 8. Any stacking order of parts 2, 3 and 4 can be accomplished as long as the intended locking effect is accomplished. In the third piece 4 an arc-like slot 10 is provided which will form an opening 14 when moved relative to slot 7 in the first handle piece 2. Above slot 10 is provided an axle aperture 17 which will receive and house together with aligned apertures 6 and 16 pin 15. Piece 4 has a small handle portion 34 that is used to hold piece 4 in alignment with piece 2 by holding the handles 34 and 12 together, an external or additional switch could also be used.

In FIG. 3 a top breakaway view of the pieces 2, 3 and 4 is illustrated. Shown in FIG. 3 is the opening or pattern 14 formed by arc-like slots 7 and 9. It is through this opening 14 that locking pin 8 wedges when jaws 5-11 are tightened against an object to be held, and plate 4 is rotated slightly. To release the lock effect, piece 4 is rotated back to a position aligning slots 7 and 10 and locking pin 8 will be released from its locking mode against the walls of opening 14.

FIG. 4 shows a side schematic view which illustrates (in 4A) the locking pin 8 in an unlocked position which is parallel to axle pin 15. First handle piece 2 is shown stacked against third piece 4 wherein slots 7 and 10 are substantially perfectly aligned. Locking pin 8 is freely movable in slots 7, 10 and 9 until rotation of piece 4 about piece 2 a locking pressure is exerted upon handle sections 12 and 13 whereupon locking pin 8 becomes distorted from parallel and is tilted against the walls of slots 7 and 10 (opening 14) to hold both first and second handle pieces 2 and 3 in a locked position as shown in FIG. 4B. Axle pin 15 remains substantially in place throughout the locking and unlocking process but locking pin 8 is distorted from parallel when locked.

As noted, while locking tools having one or four slots are illustrated in the drawings, any suitable number of slots locking pins or wedges may be used if desirable. The present disclosure describes the lock as occurring when the pins tilt towards one of the four corners created when the first and second plate, with curved slots, overlap. Diagram 4*a* and b presents only these two plates and a pin in describing the locking action. When describing the socket and its action, the third plate is seen as functioning in the rotation pliers action. The rotational and radial aspects are independent (jaws not needed). In the radial action, the slots of plate three are merely guides while the pin as wedges, cause and maintain the locking action. This locking action is described as outward/inward, riding within the radial slots of plate three. Since the two aspects (wedges and slots) are both primarily radial, the slots could serve only to possibly maintain a radial stability of the pins. The size of the pins and thickness of the curved slots and the stability of the socketed object or force can maintain this radial stability themselves making the actual slots of plate three unnecessary in the socket type lock. The wedges function in the radial locking action as the third plate does in the rotational action.

A locking tool having a plurality of arc-like slots and vertically-disposed slots can be used in the present invention. This embodiment would be similar to the tool shown in FIGS. 5A-5F in parent application Ser. No. 7/496,955. The arc-like slots of the parent application 7/496,955 spiral in opposite directions from each other while the arc-like slots in the present invention spiral in the same direction. Thus, a tool similar to FIGS. 5A-5F in Ser. No. 07/496,955 using arc-like slots that spiral in the same direction is incorporated in the present disclosure by reference and is considered embodied in the present invention.

The preferred and optimumly preferred embodiments of the present invention have been described herein and shown in the accompanying drawing to illustrate the underlying principles of the invention but it is to be understood that numerous modifications and ramifications may be made without departing from the spirit and scope of this invention.

What is claimed is:

1. A locking tool comprising in combination at least three pieces comprising a first handle piece, a second handle piece and a third piece, each of these three pieces movably connected to each other and having axle apertures in substantial alignment with each other, at least two of said three pieces having at least one arc-like slot, each positioned adjacent said axle aperture and at least one remaining piece having at least one vertically-disposed slot positioned adjacent its axle aperture, said arc-like slots spiralling in the same direction from at least one other arc-like slot in a different piece, a locking means movably disposed in each of said arc-like slots and said vertically-disposed slot, said locking means movably connecting said at least three pieces, and means to lock said first handle piece and said second handle piece in position.

2. The locking tool of claim 1 wherein at least two of said at least three pieces have jaw portions to form a gripping means.

3. The locking tool of claim 1 wherein said remaining piece having at least one vertically-disposed slot is positioned sandwiched between pieces having said arc-like slots.

4. The locking tool of claim 1 having at least one arc-like slot in said first handle piece, at least one vertically-disposed slot in said second handle piece and at least one arc-slot in said third piece.

5. The locking tool of claim 1 having at least two slots in said first handle piece, at least two slots in said second handle piece, and at least two slots in said third piece.

6. The locking tool of claim 1 wherein said vertically-disposed slot is arranged to be substantially perpendicular to said arc-like slots when said locking tool is assembled.

7. A locking tool comprising at least three movably-connected pieces, a first handle piece, a second handle piece and at least one third piece, said first handle piece having an upper jaw portion, below said jaw portion an axle aperture and at least one arc-like slot positioned at a point below said axle aperture, said second handle piece having an upper jaw portion and below said jaw portion an axle aperture, and below said axle aperture at least one vertically-disposed slot, said third piece having an axle aperture and below said axle aperture at least one arc-like slot, said arc-like slots in said second handle piece and said third piece spiralling in the same directions when said first handle piece and said second handle piece and said third piece are assembled in said locking tool, said jaw portions in said first and second handle pieces having complementary jaw portions that cooperate to form thereby a gripping means, and a locking pin positioned through each of said arc-like and vertically-disposed slots.

8. The locking tool of claim 7 wherein said second handle piece having at least one vertically-disposed slot is positioned sandwiched between said first handle piece and said third piece.

9. The locking tool of claim 7 wherein said vertically-disposed slot is arranged to be substantially perpendicular to said arc-like slots when said locking tool is assembled.

10. The locking tool of claim 7 having at least one arc-like slot in said first handle piece, at least one arc-like slot in said third piece, and at least one vertically-disposed slot in said second handle piece.

11. The locking tool of claim 7 having at least two vertically-disposed slots in said second handle piece, at least two arc-like slots in said first handle piece, and at least two arc-like slots in said third piece.

12. The locking tool of claim 7 wherein said first and second handle pieces have upper jaw sections to form gripping surfaces.

13. The locking tool of claim 7 wherein said arc-like and vertically-disposed slots are positioned below said axle apertures in each of said first handle piece, said second handle piece and said third piece.

14. The locking tool of claim 7 wherein said arc-like and vertically-disposed slots have widths slightly larger than a diameter of said locking means.

15. The locking tool of claim 7 wherein said tool has a plurality of arc-like and vertically-disposed slots, a plurality of locking means in these slots, movable wedges attached to said locking means, and a gripping area between said movable wedges.

* * * * *